US006539593B2

(12) United States Patent
Morris

(10) Patent No.: US 6,539,593 B2
(45) Date of Patent: Apr. 1, 2003

(54) TWIST-TO-ENGAGE COUPLING

(75) Inventor: John L. Morris, Durham, CT (US)

(73) Assignee: Buckles International, Inc., Meriden, CT (US)

( * ) Notice: Subject to any disclaimer, the term of this patent is extended or adjusted under 35 U.S.C. 154(b) by 0 days.

(21) Appl. No.: 09/836,727

(22) Filed: Apr. 17, 2001

(65) Prior Publication Data

US 2002/0148079 A1 Oct. 17, 2002

(51) Int. Cl.[7] ..... A44B 17/00

(52) U.S. Cl. ..... 24/265 R; 24/265 H; 24/265 CD; 24/590; 403/353

(58) Field of Search ..... 24/265 CD, 265 R, 24/265 EC, 265 H, 572, 590, 583.11, 590.1, 663, 458; 410/23; 403/353

(56) References Cited

U.S. PATENT DOCUMENTS

| | | | | |
|---|---|---|---|---|
| 104,622 A | | 6/1870 | Merlett | |
| 1,334,154 A | * | 3/1920 | Harrison | 24/265 B |
| 2,820,981 A | | 1/1958 | Klee | |
| 3,123,881 A | * | 3/1964 | Westman | 24/701 |
| 3,338,609 A | * | 8/1967 | Banas | 16/229 |
| 3,676,904 A | * | 7/1972 | Shteinshleifer | 24/265 WS |
| 3,966,340 A | * | 6/1976 | Morris | 108/156 |
| 4,005,904 A | * | 2/1977 | Weman et al. | 24/163 R |
| 4,114,401 A | * | 9/1978 | Van Hoose | 464/120 |
| 4,236,283 A | | 12/1980 | Marosy | |
| 4,338,875 A | | 7/1982 | Lisowski | |
| 4,524,495 A | | 6/1985 | Hess | |
| 4,599,768 A | | 7/1986 | Doyle | |
| 4,606,687 A | * | 8/1986 | Mantela et al. | 24/300 |
| 4,705,423 A | * | 11/1987 | Smith | 403/240 |
| 4,809,937 A | | 3/1989 | Emory, Jr. | |
| 4,850,084 A | * | 7/1989 | Iwasaki | 24/115 R |
| 5,274,887 A | * | 1/1994 | Fudaki | 24/265 H |
| 5,615,462 A | * | 4/1997 | Goto | 224/257 |
| 5,669,118 A | * | 9/1997 | Frano et al. | 24/198 |
| 5,697,320 A | | 12/1997 | Murray | |
| 5,836,061 A | * | 11/1998 | Castillo et al. | 24/115 R |
| 5,904,114 A | | 5/1999 | Wright | |
| 5,988,475 A | * | 11/1999 | Han | 224/608 |
| 6,058,576 A | | 5/2000 | Harris | |
| 6,231,068 B1 | * | 5/2001 | White et al. | 280/728.2 |
| 6,286,190 B1 | * | 9/2001 | Friend et al. | 24/115 F |

FOREIGN PATENT DOCUMENTS

| | | | | |
|---|---|---|---|---|
| GB | 2082243 A | * | 3/1982 | 403/353 |
| GB | 0575078 A1 | * | 12/1993 | 24/265 R |

OTHER PUBLICATIONS

Feb. 28, 2001, Photo of Military Pistol Belt Buckle on Web page http://www.dickies4less.com/page3.htm (bottom photograph).

* cited by examiner

*Primary Examiner*—J. J. Swann
*Assistant Examiner*—André L. Jackson
(74) *Attorney, Agent, or Firm*—R. William Reinsmith

(57) ABSTRACT

A line anchoring coupling is disclosed having a base attachable to a support surface and a complementary connector attachable to a line. The connector is insertable into a base cavity and rotatable therein into an operative position permitting the connector to swing into a position aligned with tensioning forces applied to the line.

20 Claims, 8 Drawing Sheets

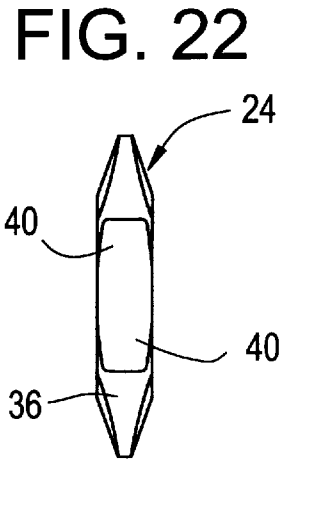
FIG. 22
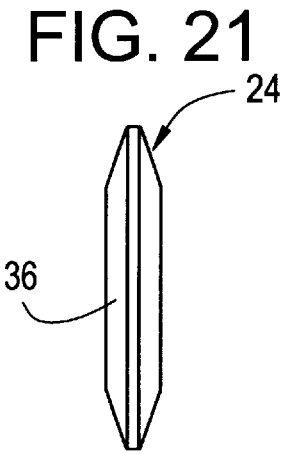
FIG. 21
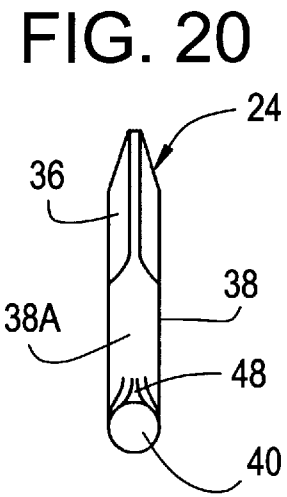
FIG. 20
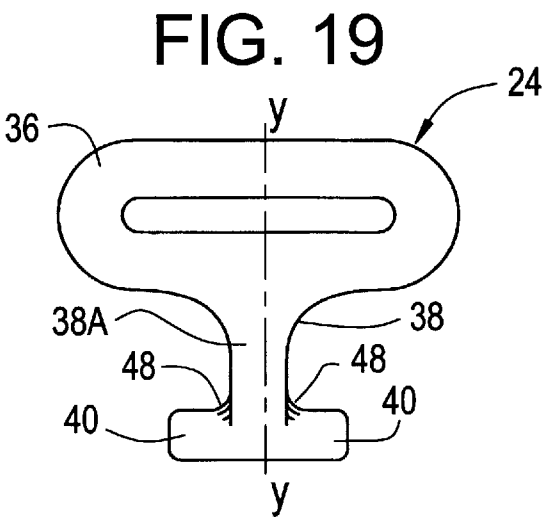
FIG. 19
FIG. 26
FIG. 25
FIG. 24
FIG. 23

TWIST-TO-ENGAGE COUPLING

FIELD OF THE INVENTION

This invention relates to a two-piece releasable coupling for anchoring a line to a support surface, for example, in securing a canopy web strap to a boat hull.

BACKGROUND OF THE INVENTION

Prior art relating to releasable couplings is replete in teachings directed to the joining of free ends of cables, belts, jewelry, halters and similar devices. However, this invention is directed to securing rope, cord, strap, cable and line at either an end or intermediate the opposite ends of a line to a fixed surface while permitting pivoting movement of one component of the coupling to permit its automatic alignment with tensioning forces applied at various angles to the line, for example, in tying down a boat cover.

Conventional means for releasably anchoring boat covers or canopies to a hull or other suitable support surfaces commonly feature metal clips and U bolts, snaps, and various clamping devices.

Known metal parts tend to corrode, creating undesirable stains on the support surface. They are difficult to connect and disconnect under tension and even may cause injury from sharp corroded edges. Clips made of non-corrosive metals are expensive. In addition, repeated contact of metal connectors with adjacent surfaces such as a fiberglass hull may cause costly cosmetic or structural damage.

OBJECTS OF THE INVENTION

Accordingly, an object of this invention is to provide a new and improved releasable coupling particularly suited to be formed of high strength material with a minimum number of components for relatively inexpensive manufacture.

Another object of t his invention is to provide such a new and improved coupling which is quick and easy to install in a variety of different applications and which minimizes forces required of a user to engage and release a line under tension.

A further object of this invention is to provide such a new and improved coupling for securing a line and which automatically adjusts a movable line connector of the coupling toward alignment with the direction of tensioning forces being applied by the line.

Yet another object of this invention is to provide such a new and improved coupling particularly suited for reliable use over extended periods of time under adverse conditions. Included in this object is the provision of a coupling particularly compatible with coated, painted, fiberglass and wood surfaces and which is quick and easy to manipulate under adverse temperature and weather conditions.

Other objects will be in part obvious and in part pointed out more in detail hereinafter.

SUMMARY OF THE INVENTION

To achieve the objects of this invention, a separable twist-to-engage coupling is disclosed having two components, namely, a base and a connector. The base is attachable to a support surface and has an exposed elongated slot and an underlying cavity communicating with the slot. The connector includes a body portion for anchoring a line and an end portion having a pair of arms joined to the body portion. The arms coaxially extend in opposite directions in perpendicular relation to a major axis of the connector. The arms are insertable through the slot of the base into its cavity and rotatable therein about the major axis of the connector into an operative position of the coupling. The body portion of the connector in the operative position of the coupling is free to swing between opposite angular positions with the arms serving as a pivot axis for the connector.

BRIEF DESCRIPTION OF THE DRAWINGS

FIG. 19 is a side view of the connector shown in FIG. 2;

FIG. 20 is an end view of the connector of FIG. 19;

FIG. 21 is a top plan view of the connector of FIG. 19;

FIG. 22 is a bottom plan view of the connector of FIG. 19;

FIG. 23 is a side view of another embodiment of a connector of the coupling of this invention;

FIG. 24 is an end view of the connector of FIG. 23;

FIG. 25 is a top plan view of the connector of FIG. 23;

FIG. 26 is a bottom plan view of the connector of FIG. 23;

A better understanding of the objects, advantages, features, properties and relations of the invention will be obtained from the following detailed description and accompanying drawings which set forth certain illustrative embodiments and are indicative of the various ways in which the principles of the invention are employed.

DESCRIPTION OF PREFERRED EMBODIMENTS

Figure 1:
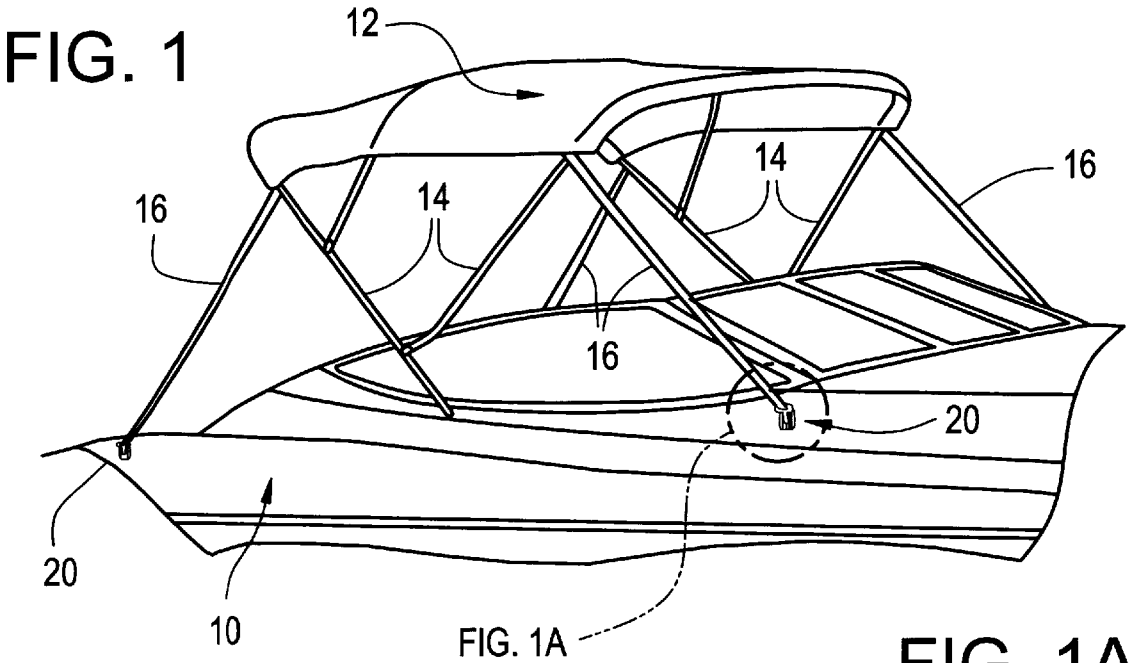
FIG. 1 is a perspective view, partly broken away, showing a canopy secured to a hull of a boat.

Referring now to FIG. 1, a boat hull is illustrated at 10 and a canopy 12 is illustrated as being supported by rigid mounting rods 14 conventionally fixed to the boat hull. To assist in firmly securing the canopy 12 in position, lines or straps 16 are commonly used. However, conventional means for fixing a line in position on a support surface have presented a host of problems as noted above.

To provide a low cost, high strength connection of canopy straps 16 under tension to the hull 10, a quick connect coupling is shown at 20 in the form of a two component assembly which is quick and easy to both manufacture and install. The preferred embodiments of this invention are disclosed for use in anchoring tensioned lines fixed to boat coverings, but it will be understood that the coupling of this invention is suited for a wide variety of applications for anchoring lines secured to different objects.

In keeping with the aim of providing a releasable device having a minimum number of parts, coupling 20 comprises a fixed base 22 and a movable connector 24 in a separable twist-to-engage device. As best seen in FIGS. 12–18, base 22 is attachable to a suitable support surface such as the boat hull 10. Base 22 has an exposed elongated slot 26, defined in part by opposed side walls 26A and 26B, and an underlying cavity 28 communicating with the slot. A flat internal face 30 overlies the cavity 28.

To provide a base which is particularly suited to be secured to a fiberglass, painted or coated surface in accordance with one aspect of this invention, the base 22 is made of resilient high strength plastics such as E.I. duPont deNemours Co. "Delrin" acetal resin. In the illustrated embodiment, base 22 is shown having a pair of apertures 32,32 for receiving suitable fasteners such as screws 34,34 for fixing the base 22 to the support surface. It is to be understood that while the base 22 is shown having a planar bottom for attachment to a flat support surface, the bottom of the base may be modified to fit the surface to which the base 22 is to be attached.

In accordance with this invention, connector 24 is provided as a one-piece component complementary to the base 22 and includes a body portion 36 with a suitable opening 36A for anchoring a line or strap 16 and an end portion 38 having a pair of arms 40,40 joined to the body portion 36 with the arms coaxially extending in opposite directions in perpendicular relation to a major axis Y—Y of the connector 24. To provide a connector which is easy and confortable to manipulate by a user under adverse conditions and which minimizes wear and abrasion of the support surface, the connector 24 may be formed of a self-lubricating high strength plastics, for example, of the same "Delrin" material as the base 22.

Figure 2:
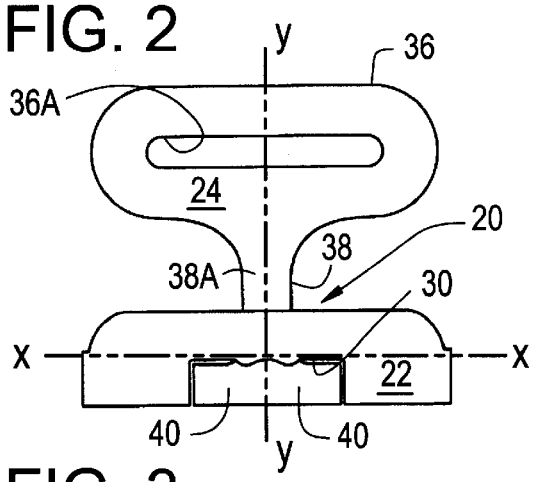
FIG. 2 is a side view of a coupling of this invention showing arms of an end portion of a connector in a ready position inside a cavity of a base of the coupling.
Figure 6:
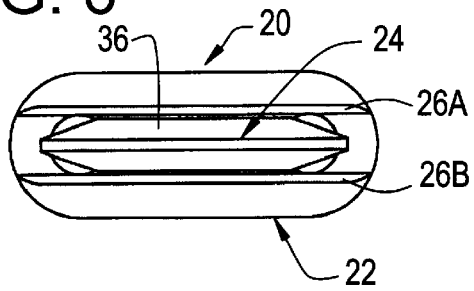
FIGS. 6–9 are plan views of the coupling of FIG. 2 showing its connector in positions corresponding respectively to FIGS. 2–5.
Figure 3:
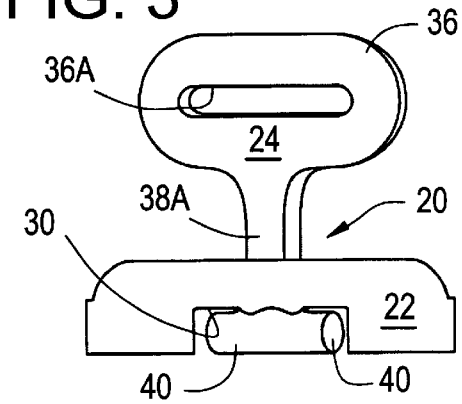
FIG. 3 is a side view of the coupling of FIG. 2 wherein the connector is angularly displaced from its ready position with its arms engaging projections on a face of the base overlying the cavity.
Figure 7:
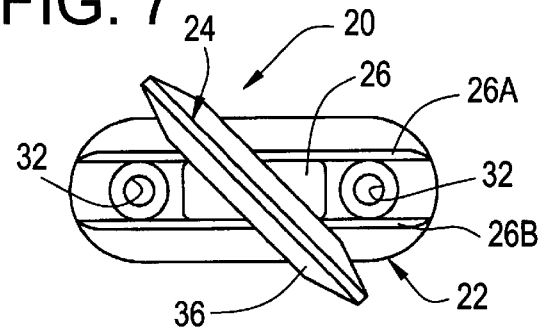
Figure 4:
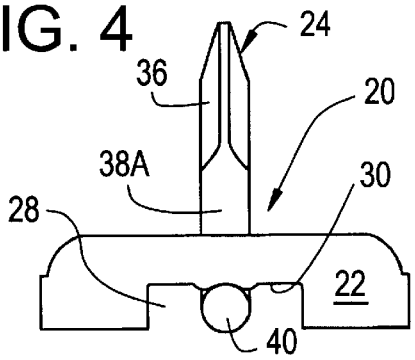
FIG. 4 is a side view of the coupling of FIG. 2 in operative position with arms of the connector received within grooves of the base.
Figure 8:
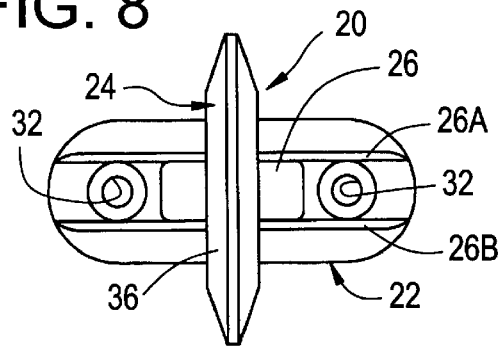
Figure 5:
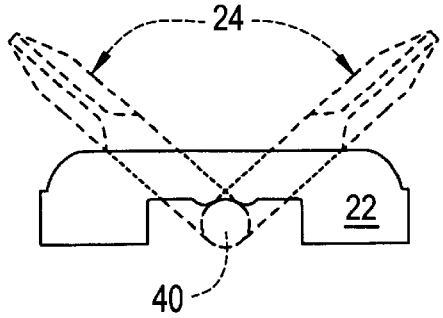
FIG. 5 is a side view of the coupling in its operative position showing its connector in broken lines in opposite angular positions.
Figure 9:
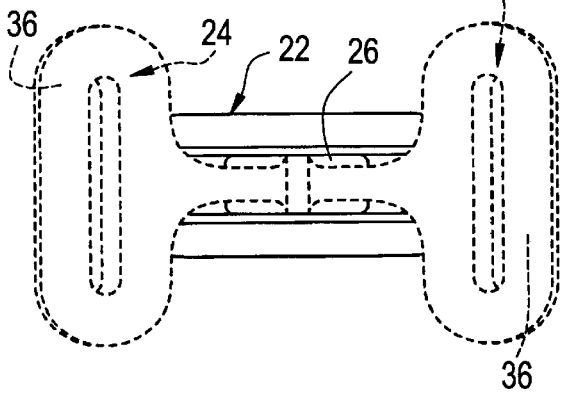
Figure 10:
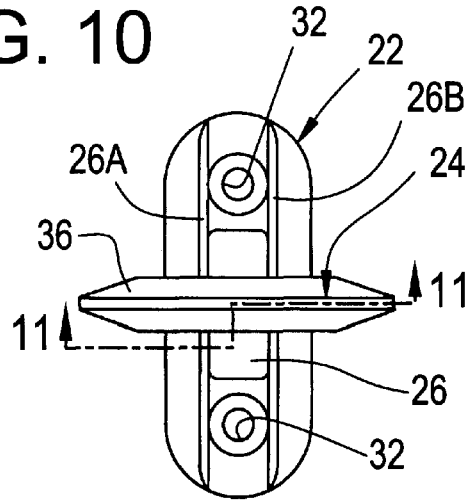
FIG. 10 is a plan view similar to FIG. 8 showing the coupling in operative position.

By virtue of the disclosed structure, the arms 40,40 of the connector 24 are insertable through slot 26 of the base 22 into its cavity 28 in a ready position (FIGS. 2 and 6) with the arms 40,40 extending in parallel alignment with a major longitudinal axis X—X of the base 22. The arms 40,40 are then rotatable (FIGS. 3 and 7) about the major axis Y—Y of the connector 24 into an operative position of coupling 20 (FIGS. 4 and 8). In the operative position of the coupling 20, body portion 36 of the connector 24 is free to swing between opposite angular positions (as best seen in FIGS. 5 and 9) with the arms 40,40 serving as a pivot axis for the connector 24. As best seen in FIG. 5, the opposite angular positions of the connector 24 are shown in broken lines, those opposite angular positions being established by engagement of the connector 24 with base 22 at opposing ends of its slot 26.

Figure 11:
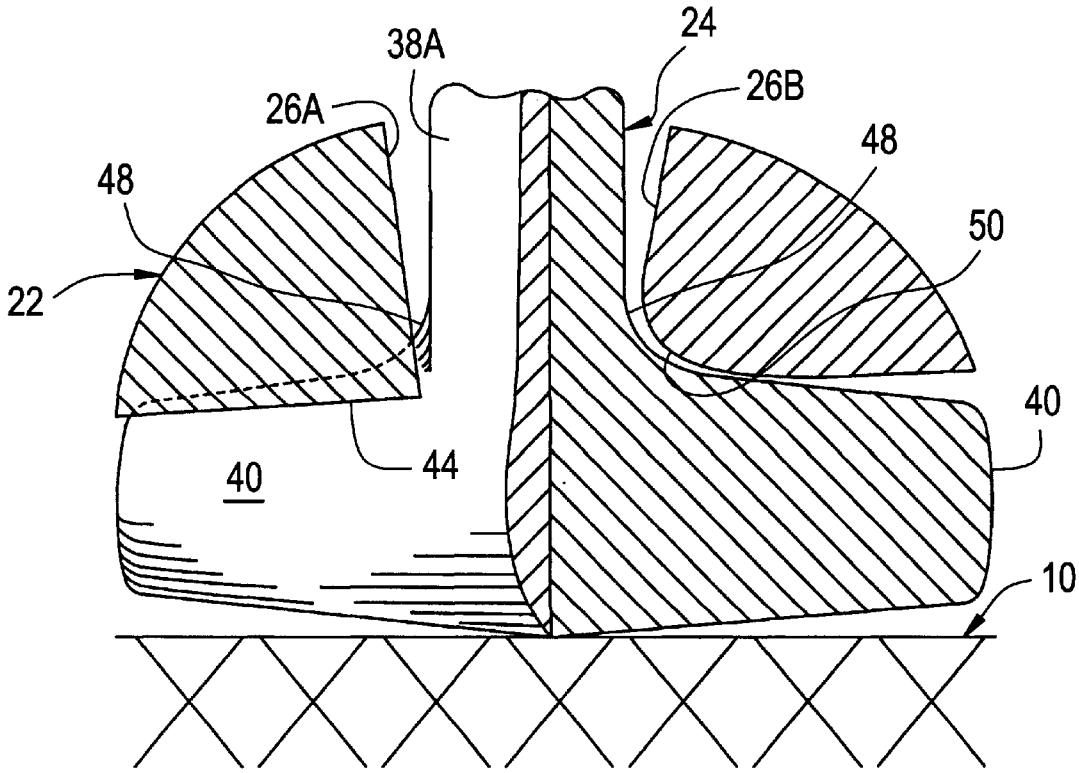
FIG. 11 is an enlarged view, partly in section and partly broken away, taken along lines 11—11 of FIG. 10.
Figure 12:
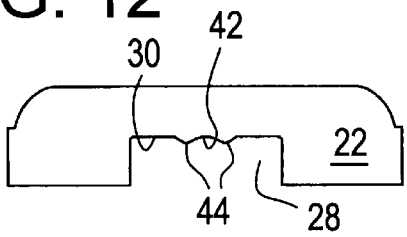
FIG. 12 is a side view of the base of the coupling.
Figure 13:
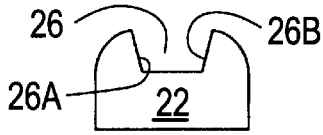
FIG. 13 is an end view of the base of FIG. 12.
Figure 14:
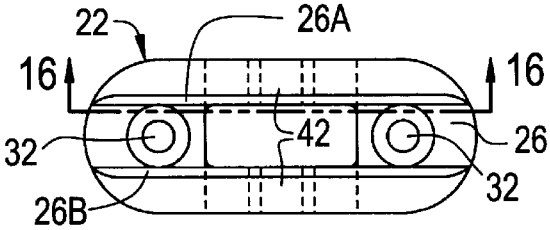
FIG. 14 is a top plan view of the base of FIG. 12.
Figure 15:
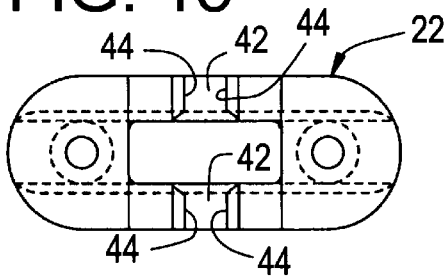
FIG. 15 is a bottom plan view of the base of FIG. 12.

To optimize retention of the connector 24 in the operative position of the coupling 20, a pair of grooves 42,42 are formed in alignment with one another midway between opposite longitudinal ends of the base 22 in perpendicular intersecting relation to the slot 26 of the base 22 as seen in FIG. 15, and projections 44,44 preferably are formed along each longitudinal edge of the grooves 42,42. Arms 40,40 each have a cross-sectional dimension greater than the minimum distance between the projections 44,44 on the base 22 and the underlying support surface 10, but less than the maximum distance between each groove face such as at 42A (FIG. 16) of the base 22 and its support surface 10. The resilient base 22 will flex upon the connector being twisted from its ready position and rotated toward its operative position with the arms 40,40 in interfering engagement with the projections 44,44 before snapping into operative position with the arms 40,40 seated within grooves 42,42. As best seen in FIG. 11, the above-described interference created by the projections 44,44 in relation to the arms 40,40 is shown in FIG. 11 with the components being dimensioned to provide snap-engagement of the connector 24 relative to the base 22 in operative position of the coupling 20. The relative dimensioning of the components additionally serves to maintain the arms 40,40 in the grooves 42,42 in the operative position of the coupling 20 and resists unintended displacement by vibration or other forces applied to the connector 24 while permitting intentional release of the connector 24 from the base 22 by twisting the connector 24 to rotate it from operative to ready positions. Thereupon, the connector 24 in its ready position simply may be removed from the base 22 through its slot 26 to effect complete separation of the coupling components.

Figure 1A:
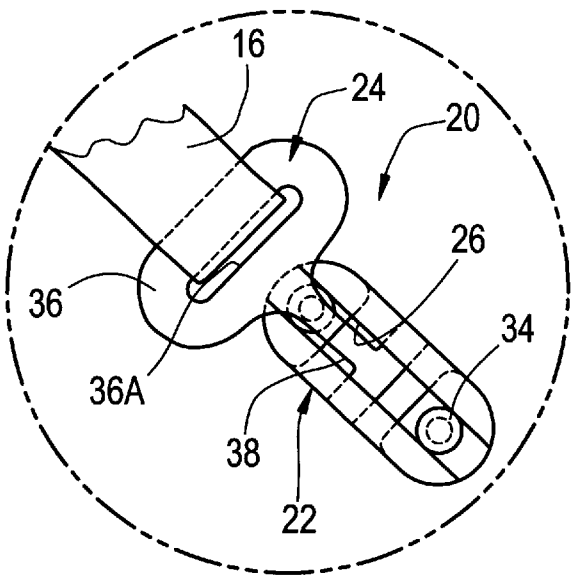
FIG. 1A is an enlarged view of a line anchoring coupling of this invention shown in FIG. 1 as being used in assisting in securing the canopy.

By virtue of the disclosed coupling, it will be appreciated that a significant advantage is achieved in improved ease of engaging and releasing connector 24 relative to base 22 when that connector is attached to line 16 via opening 36A (FIG. 1A) under tension. Unlike prior art devices requiring increased in-line tensioning forces to be directly applied to a connecting device in alignment with the tensioned line during engagement and release, the connector 24 of this invention effectively serves as a pivotable lever providing a mechanical advantage with a force vector directly in-line with the line tensioning forces of reduced magnitude for ease of engagement and release of connector 24.

Figure 16:
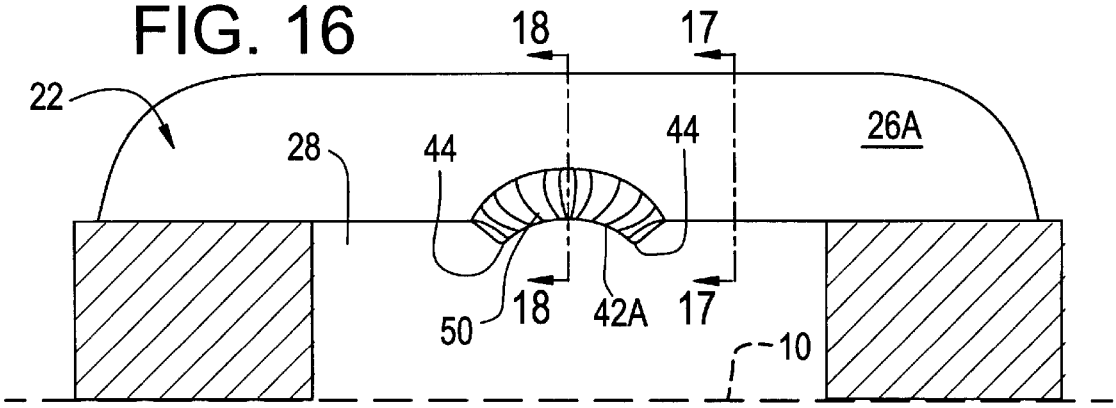
FIG. 16 is an enlarged side view, partly in section, of the base taken along line 16—16 of FIG. 14.
Figure 17:
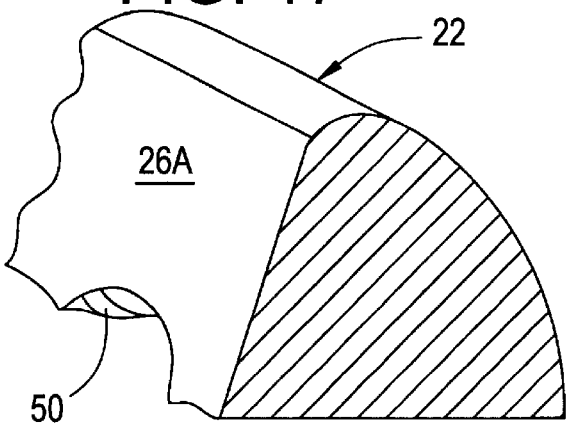
FIG. 17 is an enlarged perspective view, partly broken away and partly in section, taken along line 17—17 of FIG. 16.
Figure 18:
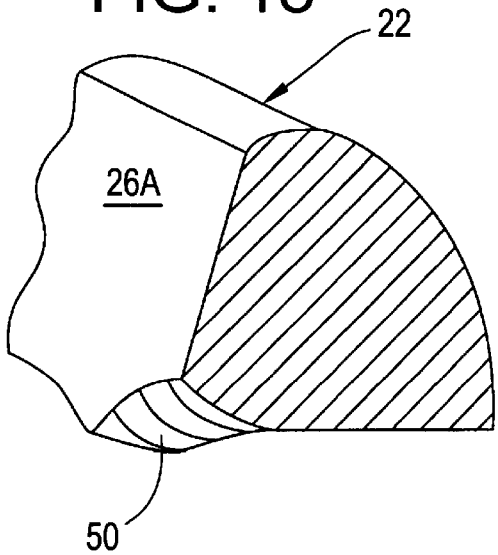
FIG. 18 is a view similar to FIG. 17 taken along line 18—18 of FIG. 16.

To effect increased torquing strength upon engagement and disengagement of the connector 24 with the base 22, a shaft 38A of the connector end portion (38 interconnecting the arms 40,40 and the body portion 36 of the connector 24) merges with each of the arms 40,40 (FIG. 11) to form arcuate junctures 48,48 complementary to opposing convex surfaces 50,50 (only one shown in FIGS. 11 and 16–18) leading into the grooves 42,42 of the base 22. As illustrated, surfaces 50,50 are formed at the intersection of each groove 42 and the slot 26 (FIG. 16).

In view of the disclosed structure, it will be appreciated that the combined length of the arms 40,40 is less than that of the base slot 36 but greater than its width, and the arms 40,40 have a maximum cross-sectional dimension less than the width of the slot 26 but greater than the minimum height of the cavity 28, the width of which approximates the length of the slot 26.

As noted in the above described embodiment, the connector end portion shaft 38A interconnects arms 40,40 to body portion 36. The end portion shaft 38A and arms 40,40 have an inverted T-shaped configuration, and the end portion 38 and body portion 36 of the connector 24 are contained in the same plane as best seen in FIGS. 20–22. This type connector 24 is particularly suited for effecting automatic adjustment of the connector 24 toward alignment with the direction of tensioning forces being applied by strap 16 contained in a plane parallel to the pivot axis of the connector.

Depending on the intended application of the coupling 20, however, it may be desirable to have the connector oriented in a position generally perpendicular to its pivot axis established by the connector arms 40,40 of the coupling 20.

To this end and to accommodate such an arrangement wherein a strap 16, for example, is contained in a plane parallel to the slot 26 of the base 22, and to again automatically achieve alignment of the connector and strap tensioning forces, another embodiment of a connector is illustrated at 124 in FIGS. 23–26. The arms 140,140 of the connector 124 are contained in a plane perpendicular to a plane containing the shaft 138A and body portion 136 of the connector 124. This structure is in contrast to the first described embodiment of the connector 24 wherein its end portion 38 and body portion 36 are contained in the same plane. In the connector embodiment of FIGS. 23–26, it will be appreciated that opposite angular positions of the connector 124 may be defined by engagement of its body portion 136 with either the base 22 or a base support surface 10.

Figure 27:
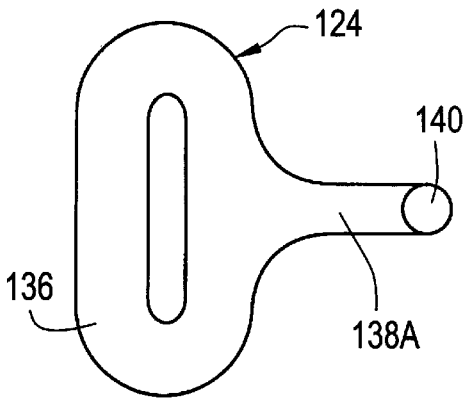
FIG. 27 is a side view of a connector similar to FIG. 23.
Figure 27A:
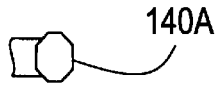
FIGS. 27A, 27B and 27C are side views, partly broken away, showing connector arms of different configurations
Figure 27B:
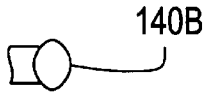
Figure 27C:
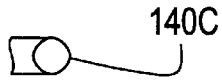

In addition, connectors having different embodiments of the cross-sectional configuration of the arms are contemplated. In contrast to the circular cross-sectional arms 140 shown in FIG. 27, connectors having hexagonal cross-sectional arms 140A (FIG. 27A) and elliptical cross-sectional arms 140B and 140C (FIGS. 27B and 27C) are also contemplated.

Figure 28:
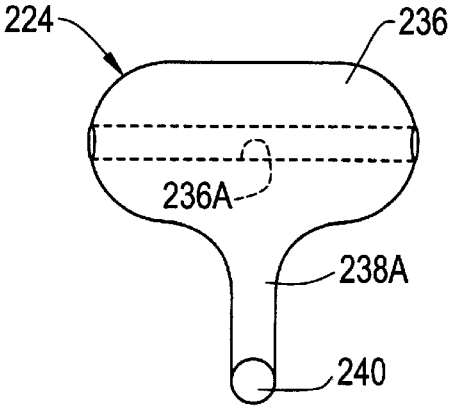
FIG. 28 is a side view showing another embodiment of a connector of the coupling.
Figure 29:
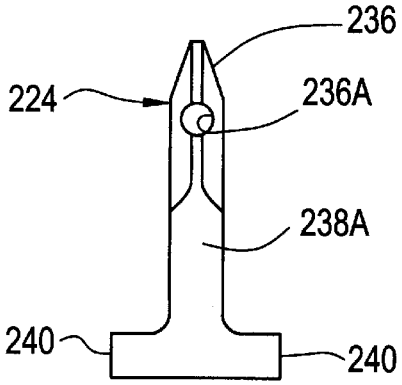
FIG. 29 is an end view of the connector of FIG. 28.

The body portion of the connector serves as a handle for manually inserting the arms into the base 22 and torquing the arms to establish the operative position of the coupling 20. That body portion also may be formed in different configurations such as illustrated in FIGS. 28 and 29. In FIG. 28, body portion 236 of connector 224 includes an opening 236A for passage of a line, not shown, through the body portion 236 with the opening 236A having its major axis contained in the plane containing the body portion 236 of the connector 224. By virtue of this particular construction, forces applied by the line cooperate to maintain the coupling in operative position, allowing tension applied to a line, bungee cord or cable, for example, running through the body portion 236 to desirably hold that connector 224 in operative position of the coupling.

Figure 30:
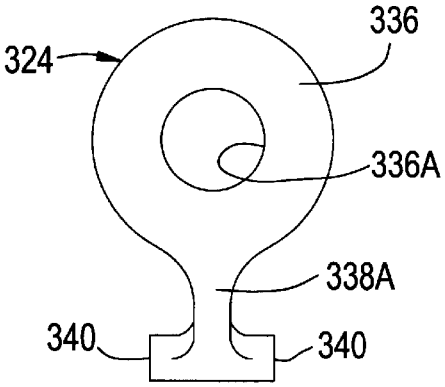
FIG. 30 is a further embodiment of a connector of the coupling.

It will be understood that this invention contemplates the use of cable, cord, strap, rope and the like, herein generally referred to as line, whereby all such line can be secured either at a free end of a line or intermediate its ends. FIG. 30 is illustrative of an alternate embodiment of a connector body portion 336 having a circular opening 336A particularly useful, for example, for securing rope.

Figure 31:
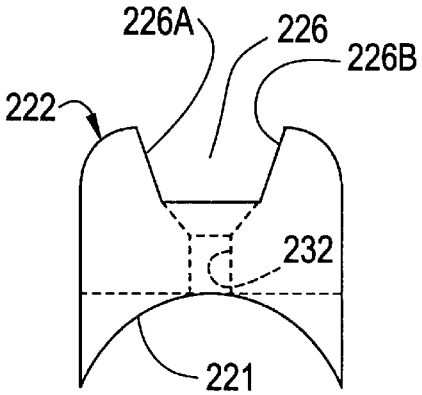
FIG. 31 is an end view of another embodiment of a base of the coupling.
Figure 32:
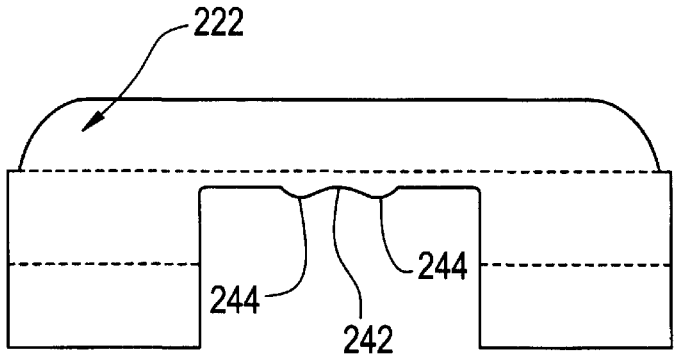
FIG. 32 is a side view of the base of FIG. 31.

Alternative embodiments of the base are contemplated as exemplified by FIGS. 31 and 32 showing a base 22 having an arcuate bottom face 221 particularly designed to be attached to a curved support structure such as a windshield rail or a trim piece of convex cross-section, not shown.

Figure 33:
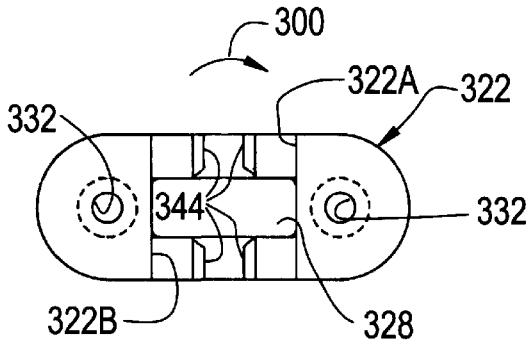
FIG. 33 is a bottom plan view of a further embodiment of a base of the coupling.

To restrain the connector arms to move in the base cavity only in one angular direction into an operative position of the coupling for a specialized coupling application, the cavity 328 in the base 322 is formed as shown in FIG. 33. FIG. 33 is a bottom plan view showing base portion walls 322A and 322B blocking movement of the connector arms, not shown, in one angular direction as shown by the arrow 300 while permitting arm movement in the opposite angular direction into operative position.

Figure 34:
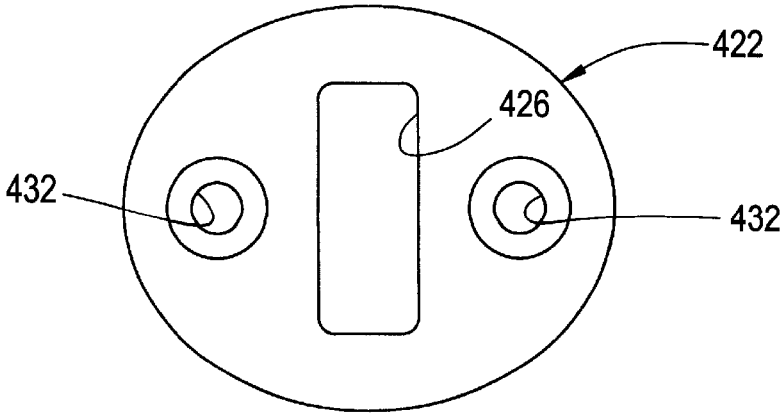
FIG. 34 is a top plan view of another embodiment of a base of the coupling.

To provide a base that blends with a particular support surface, a base 422 also may be formed with a rounded low profile having an elliptical footprint as illustrated in FIG. 34. This invention also contemplates different embodiments of the base fitted into a recess, not shown, formed in a support surface, for example.

Figure 35:
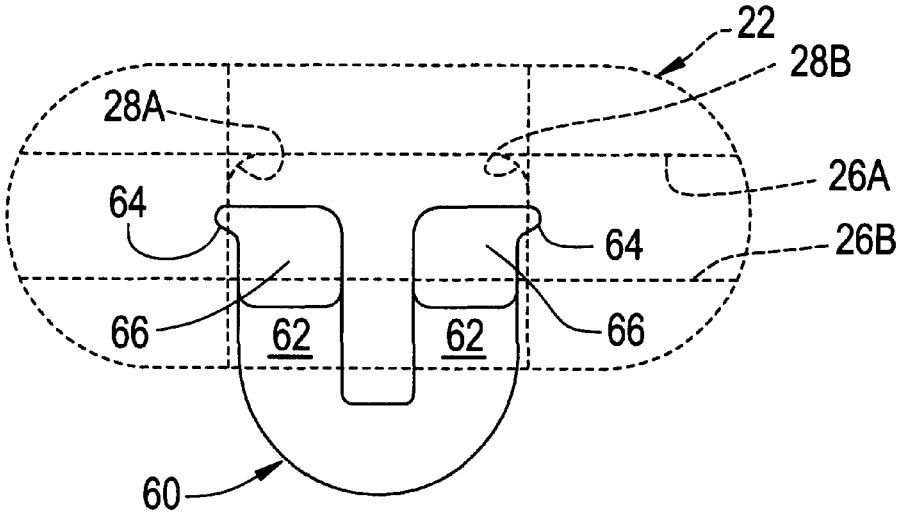
FIG. 35 is a top plan view of a locking device shown in full lines for securing a connector, not shown, in operative position on the base shown in broken lines.
Figure 36:
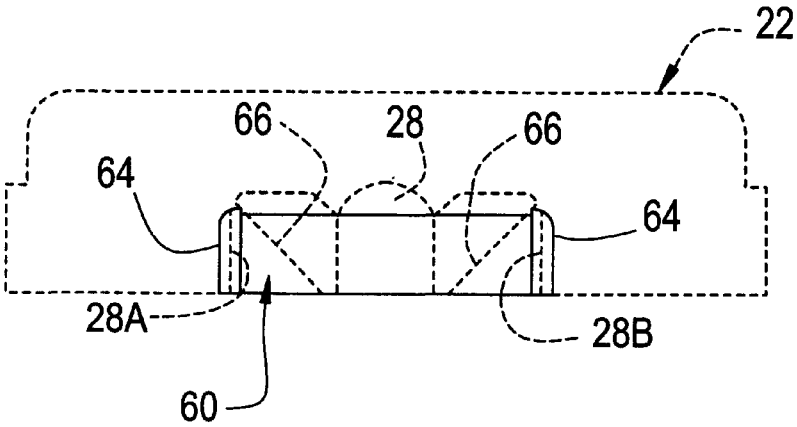
FIG. 36 is a side view of the parts shown in FIG. 35.

Were it desired to fix the coupling 20 in its operative position with the connector restrained against rotation about its shaft 38A while simultaneously permitting free swinging movement of the connector between its opposite angular positions, a locking clip 60 may be provided for the coupling 20. Such a clip is illustrated in FIGS. 35 and 36 having a generally U-shaped configuration with a pair of opposing legs 62,62 insertable into the cavity 28 of the base 22 on opposite sides of at least one of the connector arms, not shown. The locking clip 60 preferably is formed of resilient material permitting lugs 64,64 on outboard ends of the legs 62,62 to be snap-fit into complementary grooves which will be understood to be formed on interior walls 28A and 28B of the cavity 28 in the base. The legs 62,62 are each disposed between the base 22 and opposite sides of at least one arm, blocking rotation of the connector about its shaft. The terminal ends of the locking clip legs 62,62 are shown having suitably beveled surfaces 66,66 to permit free swinging movement of the connector between its opposite angular positions while maintaining the arms of the connector end portion in operative position of the coupling 20.

While the coupling formed of high strength plastics features significant advantages as described above, this invention also contemplates at least one of the base and connector members being formed of other high strength materials such as metallic materials.

Although this invention has been illustrated and described with respect to exemplary embodiments thereof, it should be understood by those skilled in the art that various changes, omissions and additions may be made without departing from the spirit and scope of the invention.

I claim:

1. A separable twist-to-engage coupling comprising a base having an exposed elongated slot, an underlying cavity communicating with the slot and a flat internal face overlying the cavity, a pair of grooves being formed in the face to extend in perpendicular intersecting relation to the slot of the base, and a connector including a body portion for anchoring a line and an end portion having a pair of arms joined to the body portion, the arms coaxially extending in opposite directions in perpendicular relation to a major axis of the connector, the arms being insertable through the slot into the cavity and rotatable about 90° therein about the major axis of the connector into an operative position of the coupling, the grooves formed in the face of the base being aligned and serving as a seat for the arms in the operative position of the coupling, the body portion of the connector in the operative position of the coupling being freely movable between opposite angular positions with the arms serving as a pivot axis for the connector.

2. The coupling of claim 1 wherein the body portion serves as a handle for manually inserting the arms of the connector into the base and torquing the arms to establish the operative position of the coupling.

3. The coupling of claim 1 wherein the base is formed of a resilient material and attachable to a support surface, wherein the flat internal face of the base includes a projection extending along each edge of the grooves, and wherein the arms each have a cross-sectional dimension greater than the minimum distance between the projections on the base and a support surface therefor but less than the maximum distance between each groove face of the base and its support surface.

4. The coupling of claim 1 wherein opposing convex surfaces are formed on the base at intersections of its slot and the grooves, wherein the connector end portion includes a shaft interconnecting the arms and the body portion of the connector, and wherein the end portion of the connector is of an inverted T-shaped configuration with the shaft merging with each of the arms to form arcuate junctures complementary to the opposing convex surfaces of the base for increased torquing strength upon engagement and enhanced retention of the connector in the operative position of the coupling.

5. The coupling of claim 1 wherein the arms have a combined length less than that of the base slot but greater than its width, wherein the arms have a maximum cross-sectional dimension less than the width of the slot but greater than the minimum height of the cavity, and wherein the cavity has a width approximately equal to the length of the slot.

6. The coupling of claim 1 wherein the base and the connector each is formed of high strength plastics.

7. The coupling of claim 1 wherein at least one of the base and connector members is formed of metal.

8. The coupling of claim 1 wherein opposite angular positions of the connector are established by engagement of the connector with the base at opposing ends of its slot.

9. The coupling of claim 1 wherein the base is attachable to a support surface, and wherein opposite angular positions of the connector are defined by engagement of its body portion with a base support surface.

10. The coupling of claim 1 wherein opposite angular positions of the connector are defined by engagement of its body portion with the base.

11. The coupling of claim 1 wherein the cavity in the base is formed to allow the connector arms to move in the cavity only in one angular direction into the operative position of the coupling.

12. The coupling of claim 1 further including a locking device insertable into the cavity of the base for engagement with a connector arm for securing the coupling in its operative position against rotation about the major axis of the connector while permitting free pivoting movement of the connector between its opposite angular positions.

13. The coupling of claim 1 wherein the base has a planar bottom suited for attachment to a flat support surface.

14. The coupling of claim 1 wherein the base has an arcuate bottom suited for attachment to a support surface of complementary shape and size.

15. The coupling of claim 11 wherein the connector end portion includes a shaft interconnecting the arms to the body portion, the end portion shaft and arms having an inverted T-shaped configuration.

16. The coupling of claim 15 wherein the end portion and the body portion of the connector are contained in the same plane.

17. The coupling of claim 15 wherein the arms of the end portion of the connector are contained in a plane perpendicular to a plane containing the shaft and the body portion of the connector.

18. The coupling of claim 17 wherein the body portion of the connector includes an opening for passage of a line through the body portion, and wherein the opening has a major axis contained in a plane containing the body portion of the connector, whereby forces applied by the line cooperate to maintain the coupling in its operative position.

19. The coupling of claim 1 wherein the body portion of the connector includes an opening for passage of a line through the body portion.

20. The coupling of claim 19 wherein the opening has a major axis extending in perpendicular relation to a plane containing the body portion of the connector.

* * * * *